US011648457B2

(12) United States Patent
Liang et al.

(10) Patent No.: US 11,648,457 B2
(45) Date of Patent: May 16, 2023

(54) TORQUE STRENGTHENING DEVICE FOR LAND SURFBOARD ADAPTERS

(71) Applicants: Tony Shan Dong Liang, County of New Castle, DE (US); Lais Cabral, County of New Castle, DE (US)

(72) Inventors: Tony Shan Dong Liang, County of New Castle, DE (US); Lais Cabral, County of New Castle, DE (US)

(73) Assignee: Innova Technology Corporation

( * ) Notice: Subject to any disclaimer, the term of this patent is extended or adjusted under 35 U.S.C. 154(b) by 0 days.

(21) Appl. No.: 17/465,861

(22) Filed: Sep. 3, 2021

(65) Prior Publication Data

US 2023/0073950 A1 Mar. 9, 2023

(51) Int. Cl.

| | |
|---|---|
| ***A63C 17/01*** | (2006.01) |
| ***A63C 17/04*** | (2006.01) |
| ***A63C 11/26*** | (2006.01) |
| ***A63C 17/00*** | (2006.01) |

(52) U.S. Cl.

CPC ..... *A63C 17/012* (2013.01); *A63C 11/26* (2013.01); *A63C 17/0046* (2013.01); *A63C 17/045* (2013.01); *A63C 2203/42* (2013.01)

(58) Field of Classification Search

CPC ... A63C 17/012; A63C 11/26; A63C 17/0046; A63C 17/045; A63C 2203/42; A63C 17/0093; A63C 10/26; A63C 2203/20; A63C 5/075

See application file for complete search history.

(56) References Cited

U.S. PATENT DOCUMENTS

| | | | | |
|---|---|---|---|---|
| 6,224,076 | B1 * | 5/2001 | Kent | A63C 17/012 280/11.28 |
| 6,655,700 | B1 * | 12/2003 | Caputo | A63C 10/106 280/14.22 |
| 7,484,741 | B2 * | 2/2009 | Kay, III | A63C 17/015 280/87.01 |
| 2001/0038187 | A1 * | 11/2001 | Reyes | A63C 17/01 280/11.25 |
| 2006/0091634 | A1 * | 5/2006 | Cole | A63C 17/01 280/87.042 |

(Continued)

FOREIGN PATENT DOCUMENTS

| | | | | |
|---|---|---|---|---|
| CN | 113227608 A | * | 8/2021 | |
| ES | 2546702 A1 | * | 9/2015 | A63C 17/0093 |

*Primary Examiner* — James A Shriver, II
*Assistant Examiner* — Michael T. Walsh

(57) ABSTRACT

The invention discloses a torque strengthening device for land surfboard adapters, comprising an upper connecting plate and a lower connecting plate, wherein a number of tension springs are connected between the upper connecting plate and the lower connecting plate; the upper connecting plate and the lower connecting plate are provided with the same number of evenly arranged spring connecting blocks on the side facing the tension springs; the number of the tension springs is twice the number of the spring connecting blocks on the upper connecting plate, and each of the spring connecting blocks is provided with two spring connecting holes; the spring connecting blocks of the upper connecting plate and the spring connecting blocks on the lower connecting plate are alternately arranged. The invention can replace tension springs with different torques to obtain different surfing feelings.

4 Claims, 3 Drawing Sheets

(56) References Cited

U.S. PATENT DOCUMENTS

| | | | | |
|---|---|---|---|---|
| 2006/0097470 | A1* | 5/2006 | Chmelar | A63C 17/0093 280/87.042 |
| 2007/0114737 | A1* | 5/2007 | Lindemann | A63C 10/14 280/14.23 |
| 2011/0089659 | A1* | 4/2011 | Hunt | A63C 17/018 280/124.121 |
| 2018/0193721 | A1* | 7/2018 | Martinez Almansa | A63C 17/0093 |
| 2021/0047789 | A1* | 2/2021 | Easter | A63C 19/02 |
| 2022/0331686 | A1* | 10/2022 | Li | A63C 17/013 |

* cited by examiner

TORQUE STRENGTHENING DEVICE FOR LAND SURFBOARD ADAPTERS

BACKGROUND OF THE INVENTION

1. Field of the Invention

The invention relates to the field of skateboard accessories, in particular to a torque strengthening device for land surfboard adapters.

2. Description of the Relater Art

Skateboarding is the originator of extreme sports history, and many extreme sports are extended from skateboarding. Skateboarding evolved from surfing in the late 1950s and early 1960s. Skateboarding is widely sought after and loved by young people because of its simplicity, ease of learning, portability, and low location limitations. Now it has become the "coolest" sport on the planet.

Most of the existing adapters for surfboards use a torsion spring to control the stability of the adapter's rotation. In the course of use, it was found that a torque spring of the adapter has poor stability when rotating, and it is easy to break during the movement, which increases the risk. Therefore, a torque strengthening device for land surfboard adapters that can ensure the stability of the adapter, is not easy to break, and improve the safety is developed.

SUMMARY OF THE INVENTION

The technical problem to be solved by the invention is to overcome the shortcomings of the above technology and provide a torque strengthening device for land surfboard adapters.

A torque strengthening device for land surfboard adapters, comprising an upper connecting plate and a lower connecting plate, wherein a number of tension springs arranged obliquely and distributed circumferentially are connected between the upper connecting plate and the lower connecting plate.

Further, the upper connecting plate and the lower connecting plate are provided with the same number of evenly arranged spring connecting blocks on the side facing the tension springs; the number of the tension springs is twice the number of the spring connecting blocks on the upper connecting plate, and each of the spring connecting block is provided with two spring connecting holes; the spring connecting blocks of the upper connecting plate and the spring connecting blocks on the lower connecting plate are alternately arranged; one end of each of the tension spring corresponds to the spring connecting block connected to the upper connecting plate, and the other end thereof corresponds to the spring connecting block connected to the lower connecting plate; a number of positioning pins are both provided on the side of the upper connecting plate and the lower connecting plate away from the tension spring; a number of screw fixing holes are both provided on the upper connecting plate and the lower connecting plate.

Further, the number of the spring connecting blocks on both the upper connecting plate and the lower connecting plate is 4, and the number of the tension springs is 8.

Further, the number of the positioning pins on the upper connecting plate and the number of the positioning pins on the lower connecting plate are both 2, and the number of the screw fixing holes on the upper connecting plate and the number of the screw fixing holes on the lower connecting plate are both 4.

Further, the center position of the upper connecting plate and the center position of the lower connecting plate are both provided with a through hole.

The advantages of the invention: the invention has reasonable structure and convenient installation; the setting of multiple tension springs enables the adapter to be more stable, balanced, smooth, and quiet when rotating, which avoids the risk of a single tension spring being easily broken during the movement, prolongs the service life of the adapter, improves the safety of land surfboards, and enhances the user experience effect; the invention can replace tension springs with different diameter to obtain different surfing feelings.

Figure 1:
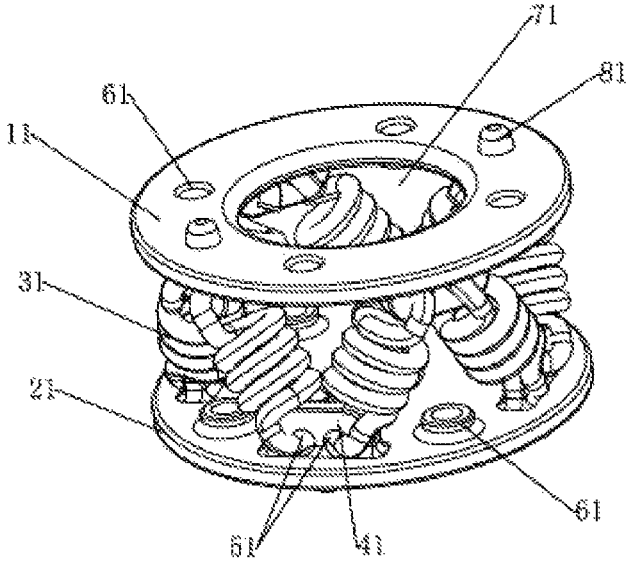
FIG. 1 is a first perspective view of a torque strengthening device for land surfboard adapters according to the invention.
Figure 2:
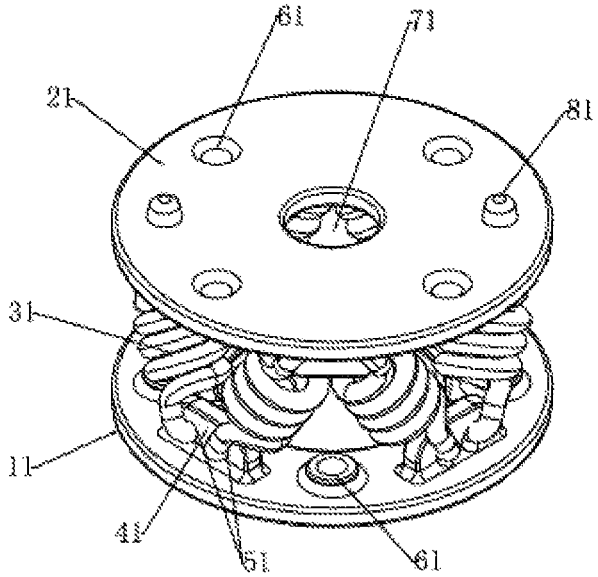
FIG. 2 is a second perspective view of a torque strengthening device for land surfboard adapters according to the invention.

In the figures, 1 refers to the fixing plate; 2 refers to the rotating plate; 3 refers to the thrust bearing; 5 refers to the bottom bracket screw; 6 refers to the locking nut; 11 refers to the upper connecting plate; 21 refers to the lower connecting plate; 31 refers to the tension spring; 41 refers to the spring connecting block; 51 refers to the spring connecting hole; 61 refers to the screw fixing hole; 71 refers to the through hole; 81 refers to the positioning pin.

DETAILED DESCRIPTION OF THE PREFERRED EMBODIMENTS

The invention will be further described in detail hereinafter with reference to the drawings.

A torque strengthening device for land surfboard adapters, comprising an upper connecting plate 11 and a lower connecting plate 21, wherein a number of tension springs 31 arranged obliquely and distributed circumferentially are connected between the upper connecting plate 11 and the lower connecting plate 21.

The upper connecting plate 11 and the lower connecting plate 21 are provided with the same number of evenly arranged spring connecting blocks 41 on the side facing the tension springs 31; the number of the tension springs 31 is twice the number of the spring connecting blocks 41 on the upper connecting plate 11, and each of the spring connecting block 41 is provided with two spring connecting holes 51; the spring connecting blocks 41 of the upper connecting plate 11 and the spring connecting blocks 41 on the lower connecting plate 21 are alternately arranged; one end of each of the tension spring 31 corresponds to the spring connecting block 41 connected to the upper connecting plate 11, and the other end thereof corresponds to the spring connecting block 41 connected to the lower connecting plate 21; a number of positioning pins 81 are both provided on the side of the upper connecting plate 11 and the lower connecting plate 21 away from the tension spring 31; a number of screw fixing holes 61 are both provided on the upper connecting plate 11 and the lower connecting plate 21. The number of the spring connecting blocks 41 on both the upper connecting plate 11 and the lower connecting plate 21 is 4, and the number of the tension springs 31 is 8. The number of the positioning pins 81 on the upper connecting plate 11 and the number of the positioning pins 81 on the lower connecting plate 21 are both 2, and the number of the screw fixing holes 61 on the upper connecting plate 11 and the number of the screw fixing holes 61 on the lower connecting plate 21 are both 4. The center position of the upper connecting plate 1 and the center position of the lower connecting plate 21 are both provided with a through hole 71.

Figure 3:
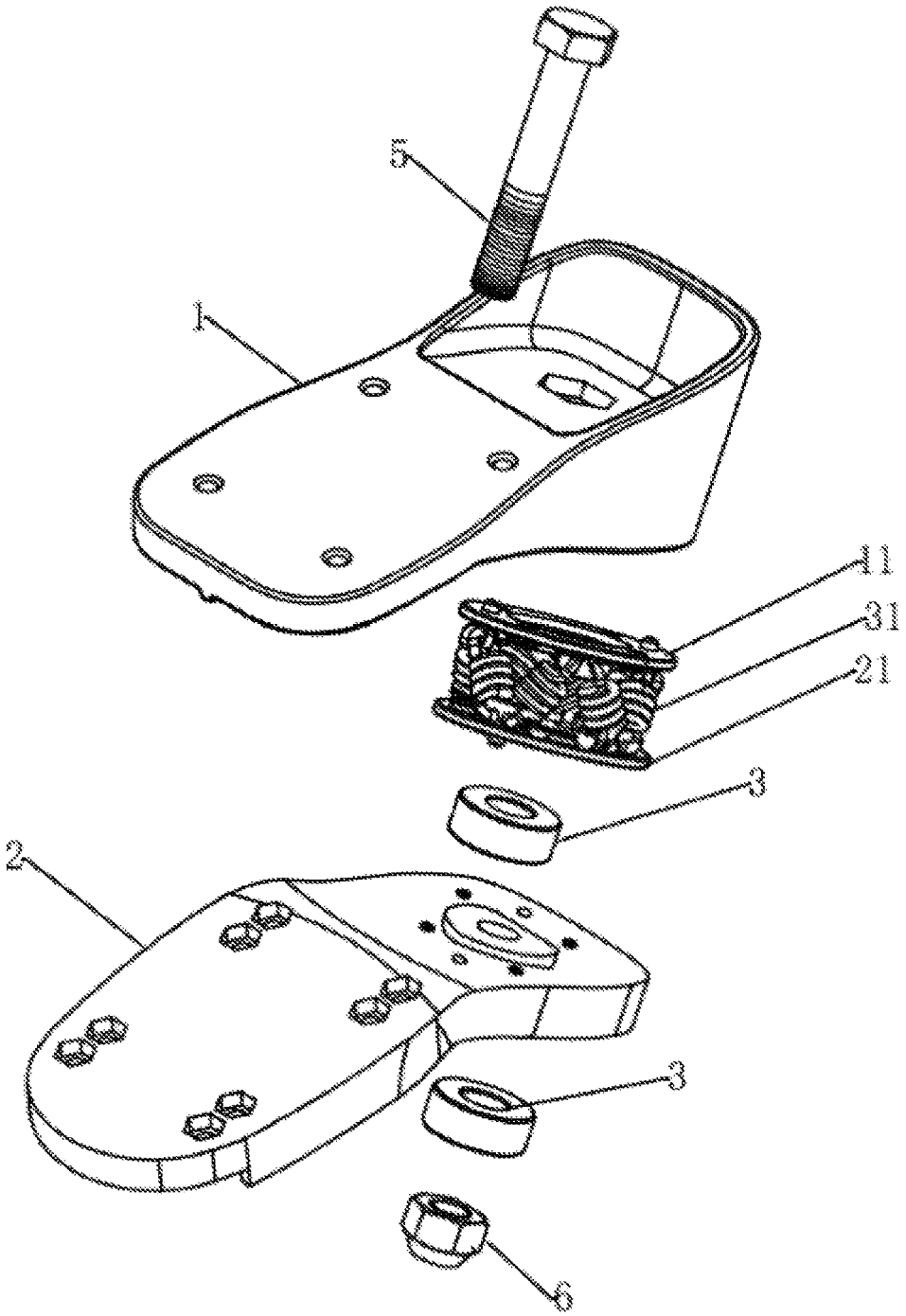
FIG. 3 is a schematic diagram of a torque strengthening device for land surfboard adapters according to the invention applied to an adapter.

When the invention is in specific use, that is, when it replaces the single torsion spring in the existing adapter, the connection of the invention is firstly positioned by the positioning pins 81 on the upper connecting plate 11 and the lower connecting plate 21, and then fixed by the screw fixing holes 61 and the fixing screws; as shown in FIG. 3, the adapter generally comprises a fixing plate 1, a rotating plate 2, a thrust bearing 3, a bottom bracket screw 5, and a locking nut 6; the fixing plate 1 and the rotating plate 2 are connected to the locking nut 6 by the bottom bracket screw 5, and the bottom bracket screw 5 is located between the fixing plate 1 and the rotating plate 2.

Figure 4:
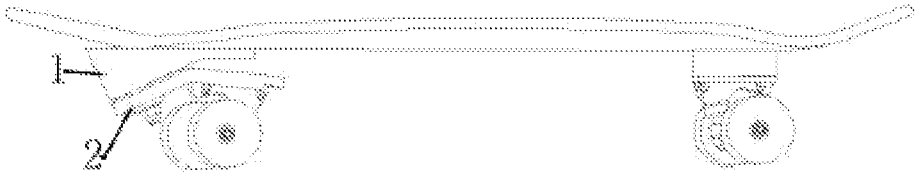
FIG. 4 is a schematic diagram of the adapter according to the invention applied to a land surfboard.

FIG. 4 is a schematic diagram of the adapter according to the invention applied to a land surfboard.

The design of the invention is convenient to install, and the adapter is more stable, balanced, smooth, and quiet when rotating. This structure can be used as tension springs with different strengths. Therefore, with the same adapter, users can replace rotating structural parts with different strengths to experience different surfing effects.

The invention can replace tension springs with different diameter to obtain different surfing feelings, that is, the spiral radius of the tension spring 41 is different, so the diameter is different, and the surfing feeling is also different.

The invention and the embodiments thereof are described hereinabove, and this description is not restrictive. What is shown in the drawings is only one of the embodiments of the invention, and the actual structure is not limited thereto. All in all, structural methods and embodiments similar to the technical solution without deviating from the purpose of the invention made by those of ordinary skill in the art without creative design shall all fall within the protection scope of the invention.

What is claimed is:

1. A torque strengthening device for land surfboard adapters, comprising an upper connecting plate (11) and a lower connecting plate (21), wherein a number of tension springs (31) arranged obliquely and distributed circumferentially are connected between the upper connecting plate (11) and the lower connecting plate (21), wherein the upper connecting plate (11) and the lower connecting plate (21) are provided with the same number of evenly arranged spring connecting blocks (41) on the side facing the tension springs (31); the number of the tension springs (31) is twice the number of the spring connecting blocks (41) on the upper connecting plate (11), and each of the spring connecting blocks (41) is provided with two spring connecting holes (51); the spring connecting blocks (41) of the upper connecting plate (11) and the spring connecting blocks (41) on the lower connecting plate (21) are alternately arranged; one end of each of the tension springs (31) corresponds to the spring connecting block (41) connected to the upper connecting plate (11), and the other end thereof corresponds to the spring connecting block (41) connected to the lower connecting plate (21); a number of positioning pins (81) are both provided on the side of the upper connecting plate (11) and the lower connecting plate (21) away from the tension spring (31); a number of screw fixing holes (61) are both provided on the upper connecting plate (11) and the lower connecting plate (21).

2. The torque strengthening device for land surfboard adapters according to claim 1, wherein the number of spring connecting blocks (41) on both the upper connecting plate (11) and the lower connecting plate (21) is 4, and the number of the tension springs (31) is 8.

3. The torque strengthening device for land surfboard adapters according to claim 1, wherein the number of positioning pins (81) on the upper connecting plate (11) and the number of positioning pins (81) on the lower connecting plate (21) are both 2, and the number of screw fixing holes (61) on the upper connecting plate (11) and the number of screw fixing holes (61) on the lower connecting plate (21) are both 4.

4. The torque strengthening device for land surfboard adapters according to claim 1, wherein the center position of the upper connecting plate (1) and the center position of the lower connecting plate (21) are both provided with a through hole (71).

* * * * *